United States Patent [19]

Reardon, Jr.

[11] 4,306,491

[45] Dec. 22, 1981

[54] FLUE SYSTEM FOR WOOD BURNING STOVES

[76] Inventor: Charles A. Reardon, Jr., 751 Plain St., Marshfield, Mass. 02050

[21] Appl. No.: 97,359

[22] Filed: Nov. 26, 1979

[51] Int. Cl.[3] ..... F23J 13/02

[52] U.S. Cl. ..... 98/60; 98/67; 98/85; 126/126; 126/280; 126/307 R

[58] Field of Search ..... 126/120, 123, 126, 307 R, 126/314, 318, 319, 317, 280; 98/58, 60, 66 R, 67, 85; 52/218, 219; 138/106, 135

[56] References Cited

U.S. PATENT DOCUMENTS

| | | | |
|---|---|---|---|
| 210,870 | 12/1878 | Morgan | 126/123 |
| 248,397 | 10/1881 | Brady | 126/280 |
| 530229 | 12/1894 | Lange | 52/218 |
| 610,396 | 9/1898 | Ganzel, Jr. | 52/218 |
| 650,026 | 5/1900 | Schoppe | 98/67 X |
| 1,578,030 | 3/1926 | Hirschberg | 98/60 X |
| 2,275,902 | 3/1942 | Hasenburger et al. | 52/219 X |
| 2,304,500 | 12/1942 | Hoesli | 52/218 X |
| 2,392,631 | 1/1946 | Berndt | 52/218 X |
| 2,408,665 | 10/1946 | Lovely | 98/67 X |
| 2,417,676 | 3/1947 | Chernack | 138/135 X |
| 2,462,383 | 2/1949 | Goodwin | 52/219 X |
| 3,183,822 | 5/1965 | Stone et al. | 98/67 X |
| 3,872,780 | 3/1975 | Zanias | 126/307 R X |
| 4,111,107 | 9/1978 | Engleke | 98/60 |

FOREIGN PATENT DOCUMENTS

| | | | |
|---|---|---|---|
| 23285 | 7/1883 | Fed. Rep. of Germany | 126/126 |
| 1232721 | 1/1967 | Fed. Rep. of Germany | 52/219 |
| 1463309 | 2/1977 | United Kingdom | 98/60 |

*Primary Examiner*—Albert J. Makay
*Assistant Examiner*—Harold Joyce
*Attorney, Agent, or Firm*—Morse, Altman, Oates and Dacey

[57] ABSTRACT

A flue system, for adapting a masonry chimney to a wood burning stove, comprises a flexible flue pipe extending from the wood burning stove upwardly through the convolutions of the chimney, and, at the top of the chimney, a control assemblage including a lower anchor plate, an upper rain cover, and extending therebetween a control pipe of particular size and construction. The control pipe has an inner shell composed of stainless steel, an outer shell also composed of a metal, and an interposed insulator. The control pipe is of the correct length and diameter to be heated by the flue gas to a temperature at which creosote condensation at the top of the chimney is minimized or prevented.

2 Claims, 4 Drawing Figures

Fig. 3
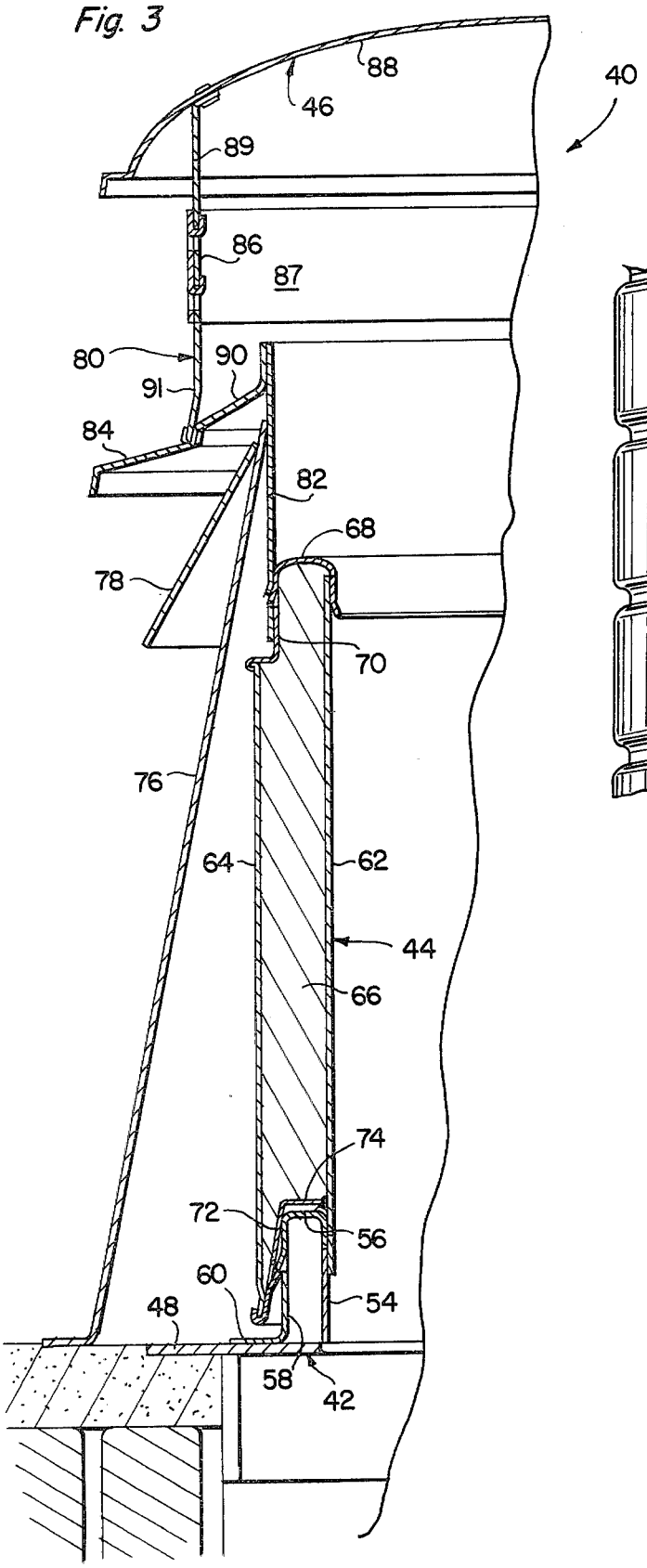
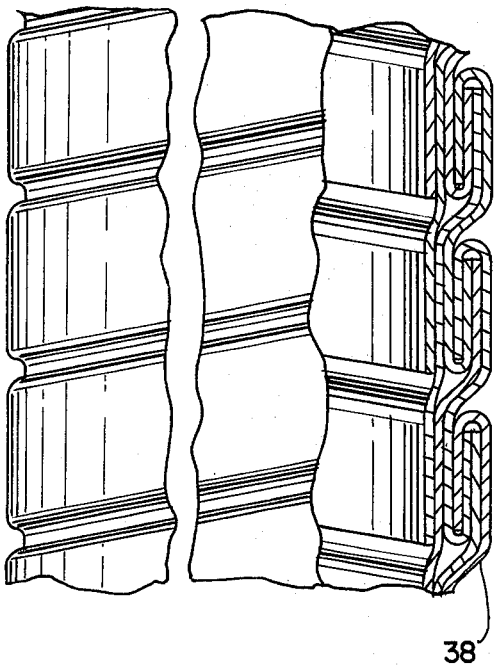
Fig. 4

FLUE SYSTEM FOR WOOD BURNING STOVES

BACKGROUND OF THE INVENTION

1. Field of the Invention

The present invention relates to flue systems and, more particularly, to flue systems of the type in which a flexible flue of lesser diameter is extended through a masonry chimney of greater diameter for such a purpose as improving the safety or function of the masonary chimney.

2. The Prior Art

Difficulties have been encountered in using conventional masonry chimneys for woodburning stoves and in adapting conventional masonary chimneys for use with wood burning stoves by extending auxilliary flues through such masonry chimneys.

Conventional masonry chimneys provide relatively large diameter flues and intricately sharp bends. When wood burns, it generates heat, as well as several gases, including water vapor, carbon dioxide, and creosote. In such chimneys, heavy downdrafts and upper level cooling cause creosote to condense, often in inaccessible regions. Since condensed creosote forms an inflammable tar, such condensation creates a fire hazard.

Brief Summary of the Invention

The object of the present invention is to solve problems of the foregoing type by providing a novel flue system for adapting a masonry chimney to a wood burning stove. This flue system comprises a flexible flue pipe of restricted diameter gently curved where needed, extending from a wood burning stove upwardly through the contours of the chimney, and, at the top of the chimney, a control assemblage including a lower anchor plate, an upper rain cover, and extending therebetween a control pipe of particular size and construction. The control pipe has an inner shell composed specifically of stainless steel, an outer shell composed, for example, of stainless steel, and an interposed insulator. The control pipe is of the correct length and diameter to be heated by the flue gas to a temperature at which creosote condensation at the top of the chimney is minimized or prevented.

The invention accordingly comprises the system, together with its parts and their interrelationships, which are illustrated in the present disclosure, the scope of which will be indicated in the appended claims.

BRIEF DESCRIPTION OF THE DRAWINGS

For a fuller understanding of the nature and objects of the present invention, reference is made to the following description, which refers to the accompanying drawings, wherein:

FIG. 3 is a broken away, cross-section of the control assemblage of FIG. 1 in operative condition; and FIG. 4 is a cross-sectional view os a segment of the flexible flue of the present invention.

DESCRIPTION OF THE PREFERRED EMBODIMENT

Figure 1:
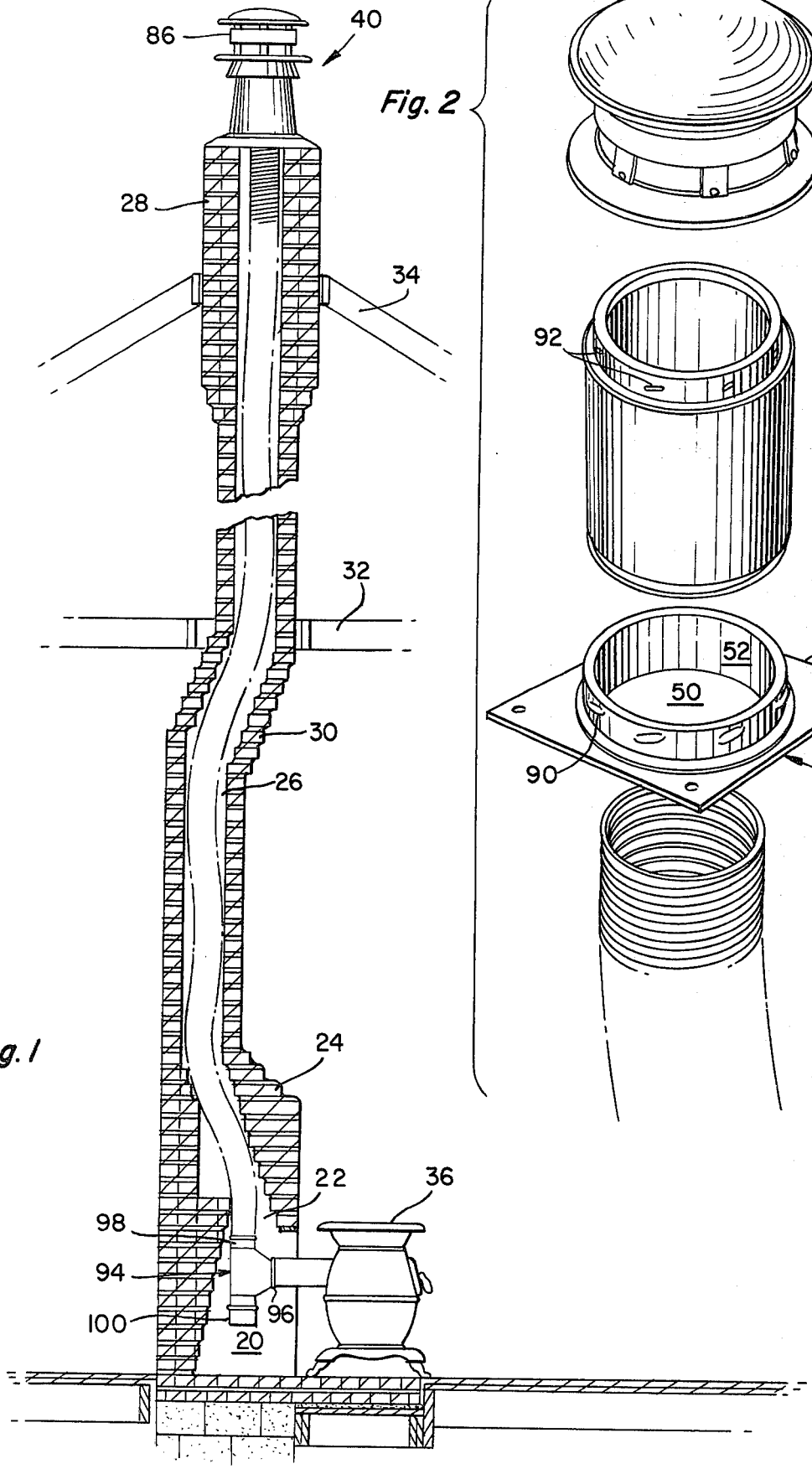
FIG. 1 is an elevation, partly in cross-section, of a wood-burning system embodying the present invention.

Generally, as shown in FIG. 1, the illustrated system is associated with a conventional brick and morter chimney including a firebox 20, a damper 22, a mantel 24, a flue 26, and a stack 28. It will be observed that the chimney has a sharp bend at 30, by which it extends through flooring 32 and through a desired part of roofing 34. A wood burning stove 36 is located in front of firebox 20.

A flexible flue pipe, from 5 to 10 inches in diameter and within the chimney cross-section, extends from stove 36 through damper 22 and flue 26 to the top of stack 28, being smoothly curved at bend 30. As shown in FIG. 4, the flexible flue pipe is composed of spiral convolutions 38, the contiguous edges of adjacent convolutions being flexibly interlocked by reversly bent flanges that are mated with sufficient freedom to permit limited movement between the convolutions. Preferably spiral convolutions are composed of galvanized steel, their inner surfaces being composed of stainless steel to provide an abrasion and corrosion resistant lining.

Figure 2:
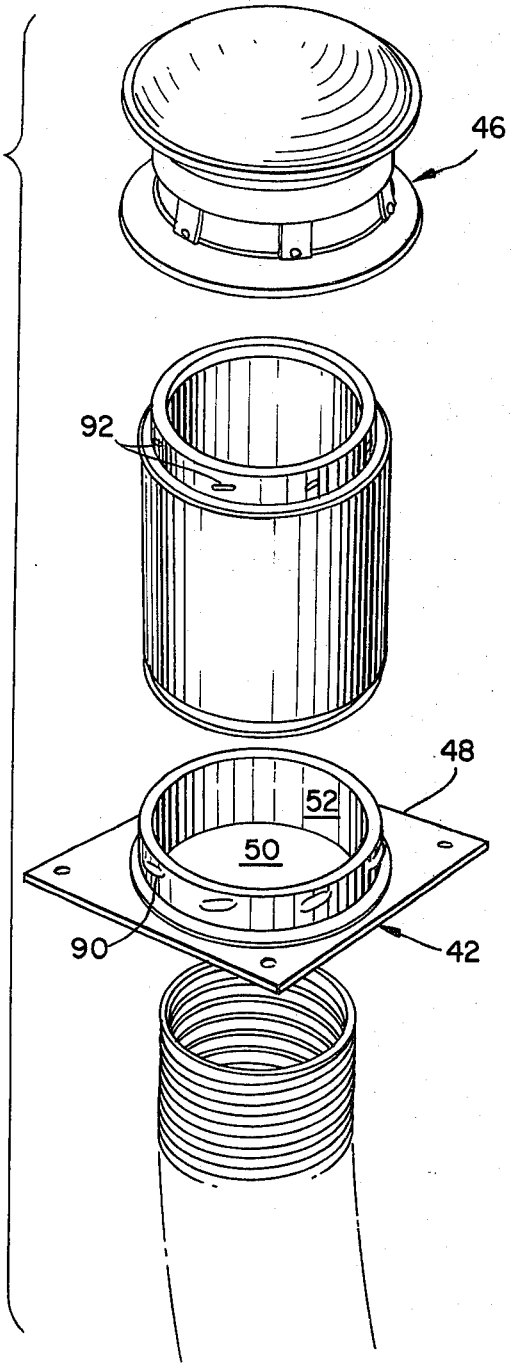
FIG. 2 is an exploded view of the control assemblage of the system of the present invention.

Communicating with the top of the flue pipe is a control assemblage 40, which now will be described. As shown in FIGS. 1, 2, and 3, control assemblage 40 includes an anchor sub-assembly 42, a control pipe sub-assembly 44, and a cover sub-assembly 46.

Anchor sub-assembly 42 includes a plate 48 having a central opening 50. Surrounding opening 50 and extending upwardly therefrom is a rim 52, which, as shown in FIG. 3, is an integral sheet metal construction having an inner shell 54, an upper bight 56, and an outer shell 58. The lower edge of inner shell 54 is welded or otherwise connected to plate 48 and the lower edge of outer shell 58 has an outwardly flared flange 60, which is welded or otherwise connected to plate 48. Preferably plate 48 is composed of galvanized steel and portions 54, 56, and 58 are composed of stainless steel.

Control pipe sub-assembly 44 includes an inner shell 62, an outer shell 64, and interposed insulation 66. Inner shell 62 must be composed of stainless steel. Outer shell preferably is composed of stainless steel. Insulation 66, for example, is composed of fiberglass felt. At the top of the control pipe is an enclosing open bottom annular shell 68 that provides an outer shoulder 70. At the bottom of the control pipe is an enclosing annular shell 72 that provides an inner shoulder 74. Annular shell 68 and annular shell 72 are formed from shaped sheet metal, composed preferably of stainless steel.

Cover sub-assembly 40 includes a lower shroud 76, a medial storm collar 78, and an upper rain cap 80. Rain cap 80 includes a lower collar 82, a hood 84, a cylindrical reticulated cage 86, and a lid 88. Cage 86 includes a ring 87 to which are fasened struts 89 downwardly extending from lid 88 and struts 91 upwardly extending from hood 84. Lid 88 is riveted to struts 89. Cage 86 and hood 84 are carried on inner collar 82 by a suitable spider 90. Preferably, each of lid 88, cage 86, hood 84, and spider 90 are composed of stainless steel.

OPERATION

In operation, the flexible flue pipe is extended in the chimney from the wood burning stove to control assemblage 40. The flexible flue pipe curves gradually through damper 22 and bend 30 to provide a smooth conduit for gases escaping from wood-burning stove 36. At the top of stack 28, the top of the flexible flue pipe fits snugly into the inner shell of rim 52, which is substantially of the same diameter as the flexible flue pipe. Rim 52 and shoulder 70 are provided respectively with oblique lugs 90 and 92, which mesh respectively with corresponding lugs on annulus 72 and collar 82 when control pipe 44 is twisted onto shoulder 68. The stainless steel components of control assemblage 40 provide an abrasion and corrosion resistant lining of predetermined diameter. Preferably the circumference of inner shell 62 ranges in diameter from 5 to 10 inches (15.2 to 20.3 centimeters) and the length of the control pipe sub-assembly, i.e. the length of inner shell 62, ranges from 3 to 36 inches (7.5 to 90 centimeters). Reducing the cubic volume of the effective chimney reduces the cooling effect on flue gases, accelerates the draft, and allows more rapid expansion of the gas, thereby precluding creosote condensation. A cleanout tee 94, connected at 98 to the flexible flue pipe and at 96 to stove 36, has a lower cap 100, which can be opened for cleaning purposes.

Since certain changes may be made in the present disclosure without departing from the scope of the invention herein involved, it is intended that all matter contained in the foregoing description or shown in the accompanying be interpreted in an illustrative and not in a limiting sense.

What is claimed is:

1. A control system for a masonry chimney, said control system comprising:

(a) a flexible flue pipe for extending from a wood burning stove upwardly through a masonry chimney to an anchor sub-assembly mounted at the top of said chimney, said flue pipe comprising a plurality of spiral convolutions, with contiguous edges of adjcent convolutions being flexibly interlocked by reversely bent flanges;

(b) a control pipe sub-assembly connected to said anchor sub-assembly; and (c) a cover sub-assembly mounted on said control pipe sub-assembly, (d) said control pipe sub-assembly including an inner shell having a stainless steel surface, an outer shell, and insulation interposed between said inner shell and said outer shell, said control pipe sub-assembly being characterized by having a length and a diameter so as to minimize condensation at said cover sub-assembly;

(e) said anchor sub-assembly including an anchor plate for attachment at the top of said chimney, an annular shoulder rising upwardly therefrom, and first oblique lugs projecting from said annular shoulder, said cover sub-assembly including a lower collar, a medial hood, an upper cap, and second oblique lugs projecting from said lower collar;

(f) said control pipe sub-assembly having an upper annular shoulder rising therefrom, a lower annular shoulder depending therefrom, third oblique lugs projecting from said upper annular shoulder, and fourth oblique lugs projecting from said lower annular shoulder;

(g) said second oblique lugs and said third oblique lugs meshing to lock said control pipe sub-assembly to said cover sub-assembly, said first oblique lugs and said fourth oblique lugs meshing to lock said control pipe sub-assembly to said anchor sub-assembly.

2. The control system of claim 1 wherein said control pipe sub-assembly ranges in diameter from 15.2 to 20.3 centimeters and the length of said control pipe sub-assembly ranges in diameter from 7.5 to 90.0 centimeters, said control system including a cleanout tee connected between said flexible flue pipe and said stove.

* * * * *